US011098509B2

(12) United States Patent
Huang et al.

(10) Patent No.: US 11,098,509 B2
(45) Date of Patent: Aug. 24, 2021

(54) DOUBLE-DOOR LOCK ASSEMBLY

(71) Applicant: TAIWAN FU HSING INDUSTRIAL CO., LTD., Kaohsiung (TW)

(72) Inventors: Chao-Ming Huang, Kaohsiung (TW); Yu-Cheng Lin, Tainan (TW)

(73) Assignee: TAIWAN FU HSING INDUSTRIAL CO., LTD., Kaohsiung (TW)

( * ) Notice: Subject to any disclaimer, the term of this patent is extended or adjusted under 35 U.S.C. 154(b) by 346 days.

(21) Appl. No.: 16/261,783

(22) Filed: Jan. 30, 2019

(65) Prior Publication Data

US 2019/0153756 A1 May 23, 2019

Related U.S. Application Data

(63) Continuation-in-part of application No. 15/653,680, filed on Jul. 19, 2017, now Pat. No. 10,233,669.

(30) Foreign Application Priority Data

May 9, 2017 (TW) ..... 106115225
Nov. 23, 2018 (TW) ..... 107141798

(51) Int. Cl.
*E05C 7/02* (2006.01)
*E05B 15/00* (2006.01)
(Continued)

(52) U.S. Cl.
CPC ..... *E05C 7/02* (2013.01); *E05B 15/0073* (2013.01); *E05B 55/005* (2013.01);
(Continued)

(58) Field of Classification Search
CPC ..... E05B 65/04; E05B 9/10; E05B 47/0038; E05B 15/0073; E05B 55/005; E05B 63/143; E05B 63/04; E05C 7/02; E05Y 2900/132
(Continued)

(56) References Cited

U.S. PATENT DOCUMENTS 525,906 A 9/1894 Johnson
1,140,524 A 5/1915 Mosier et al.
(Continued)

FOREIGN PATENT DOCUMENTS

CN 1995670 A 7/2007
CN 101649715 A 2/2010
(Continued)

OTHER PUBLICATIONS

Taiwanese Notice of Allowance dated Jun. 28, 2019 for Taiwanese Patent Application No. 107141798, 3 pages.
(Continued)

*Primary Examiner* — Suzanne L Barrett

(74) *Attorney, Agent, or Firm* — Demian K. Jackson; Jackson IPG PLLC

(57) ABSTRACT

A double-door lock assembly includes a first lock and a second lock which are mounted to a first door and a second door, respectively. The first lock includes a first rotary member, a first magnetic member and a linkage member. The second lock includes a second rotary member having a driving portion and a second magnetic member. The first and second rotary members can be driven to rotate together to open or close the first and second doors simultaneously when the first and second magnetic members are attracted to each other and the driving portion on the second rotary member contacts against the linkage member on the first rotary member.

23 Claims, 11 Drawing Sheets

(51) Int. Cl.
*E05B 63/14* (2006.01)
*E05B 55/00* (2006.01)
*E05B 63/04* (2006.01)

(52) U.S. Cl.
CPC ..... *E05B 63/143* (2013.01); *E05B 63/04* (2013.01); *E05Y 2900/132* (2013.01)

(58) Field of Classification Search
USPC ..... 70/224; 49/67, 65; 292/57, 59, 336.3
See application file for complete search history.

(56) References Cited

U.S. PATENT DOCUMENTS

| | | | | |
|---|---|---|---|---|
| 1,686,819 | A | 10/1928 | Kirschbaum | |
| 1,920,813 | A | 8/1933 | Storms | |
| 2,219,344 | A | 10/1940 | Taylor | |
| 2,537,896 | A | 1/1951 | Hinton | |
| 4,208,837 | A | 6/1980 | Black, Sr. | |
| 4,302,907 | A | 12/1981 | Canals | |
| 4,408,546 | A | 10/1983 | Schmidt | |
| 4,470,276 | A | 9/1984 | Bayless | |
| 4,660,873 | A | 4/1987 | Sholund | |
| 4,891,907 | A | 1/1990 | Rapaway | |
| 5,474,345 | A | 12/1995 | Clark | |
| 6,357,509 | B1 | 3/2002 | Lamazares | |
| 6,860,129 | B2 | 3/2005 | Eller et al. | |
| 9,540,853 | B2 | 1/2017 | Pickar | |
| 10,233,669 | B2 * | 3/2019 | Huang | E05B 65/087 |
| 10,808,438 | B2 * | 10/2020 | Takase | E05B 47/0038 |

FOREIGN PATENT DOCUMENTS

| | | | | |
|---|---|---|---|---|
| CN | 206465754 | U | 9/2017 | |
| CN | 108868376 | A | 11/2018 | |
| TW | 1611089 | | 1/2018 | |
| WO | 98/44227 | A1 | 10/1998 | |
| WO | WO-2017181072 | A1 * | 10/2017 | E06B 7/2316 |

OTHER PUBLICATIONS

Chinese Office Action dated Dec. 10, 2020 for Chinese Patent Application No. 201811573252.8, 7 pages.

* cited by examiner

DOUBLE-DOOR LOCK ASSEMBLY

CROSS-REFERENCE TO RELATED APPLICATIONS

This application is a continuation-in-part of U.S. application Ser. No. 15/653,680, filed on Jul. 19, 2017, which claims priority to Taiwan Patent Application No. 106115225, filed on May 9, 2017. This application also claims priority to Taiwan Patent Application No. 107141798, filed on Nov. 23, 2018. All of the foregoing applications are incorporated herein by reference in its entirety.

FIELD OF THE INVENTION

This invention relates to a double-door lock assembly which is designed to be mounted on a first door and a second door and provided to open and close the first door and the second door simultaneously or individually.

BACKGROUND OF THE INVENTION

For the purpose of burglar-proof ventilation or natural light, a first door and a second door are mounted to a door frame and a first lock and a second lock are assembled on the first and second doors, respectively. In order to open the first and second doors, user has to operate the first lock to open the first door and then operate the second lock to open the second door. That is inconvenient for use, and additionally, more space is required for the opened doors if the first and second doors are designed to be open in opposite directions.

In order to solve the problems mentioned above, the present inventors designed a double-door lock assembly and filed a Taiwan Patent Application No. 106115225 (now Pat. No. TW 1611089 B), a U.S. patent application Ser. No. 15/653,680 (now Pub. No. US 2018/0328077 A1) and a China Patent Application No. 201710539100.5 (now Pub. No. CN 108868376 A).

SUMMARY

The object of the present invention is to improve cooperation reliability of first and second locks during actuation of the lock assembly.

One double-door lock assembly of the present invention for operating a first door and a second door simultaneously or individually comprises a first lock and a second lock. The first lock is mounted on the first door and includes a first handle set, a first rotary member rotated by the first handle set, at least one first magnetic member and a linkage member. The first magnetic member and the linkage member are disposed on and moved with the first rotary member. The linkage member is movably disposed in an accommodation hole of the first rotary member and able to be moved into or protruded from the accommodation hole. A first end of the linkage member has a blocking surface. The second lock is mounted on the second door and includes a second handle set, a second rotary member rotated by the second handle set, at least one second magnetic member and a driving portion. The second magnetic member and the driving portion are disposed on and moved with the second rotary member. When the first and second magnetic members are attracted to each other and the linkage member is protruded from the accommodation hole, the driving portion contacts against the blocking surface of the linkage member such that the first and second rotary members are able to be rotated together.

Another double-door lock assembly of the present invention for operating a first door and a second door simultaneously or individually comprises a first lock and a second lock. The first lock is mounted on the first door and includes a first handle set, a first rotary member rotated by the first handle set and a linkage member disposed on and moved with the first rotary member. The linkage member is movably disposed in an accommodation hole of the first rotary member and able to be moved into or protruded from the accommodation hole. A first end of the linkage member has a blocking surface and an inclined guide surface which are located on different sides of the first end. The second lock is mounted on the second door and includes a second handle set, a second rotary member rotated by the second handle set and a driving portion disposed on and moved with the second rotary member. The first and second rotary members are able to be rotated together when the driving portion contacts against the blocking surface of the linkage member protruded from the accommodation hole. And the first and second rotary members are able to be separated from each other when the driving portion contacts against the inclined guide surface of the linkage member protruded from the accommodation hole to move the linkage member into the accommodation hole.

The lock assembly of the present invention utilizes the attraction between the first and second magnetic members and the mutual contacting of the linkage member on the first rotary member and the driving portion on the second rotary member to enhance cooperation reliability of the first and second locks during actuating the lock assembly.

DETAILED DESCRIPTION OF THE INVENTION

Figure 1:
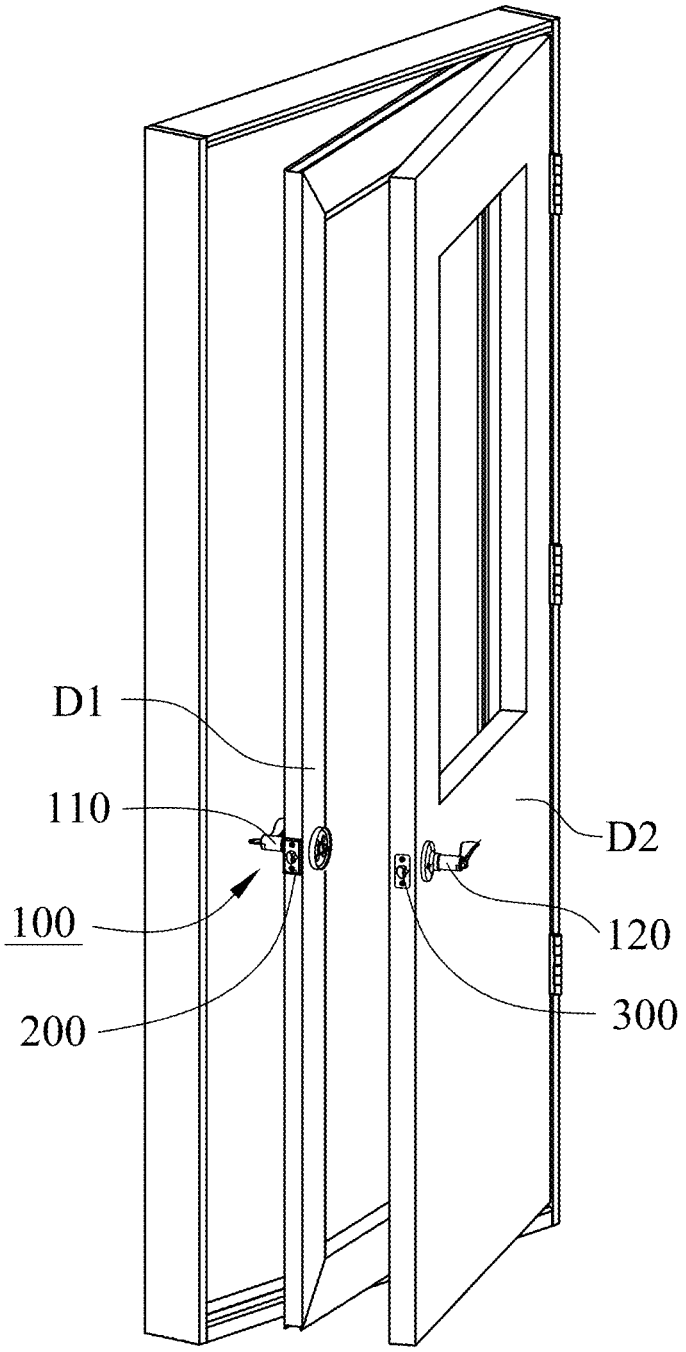
FIG. 1 is a perspective assembly diagram illustrating a lock assembly mounted on a first door and a second door in accordance with an embodiment of the present invention.
Figure 2:
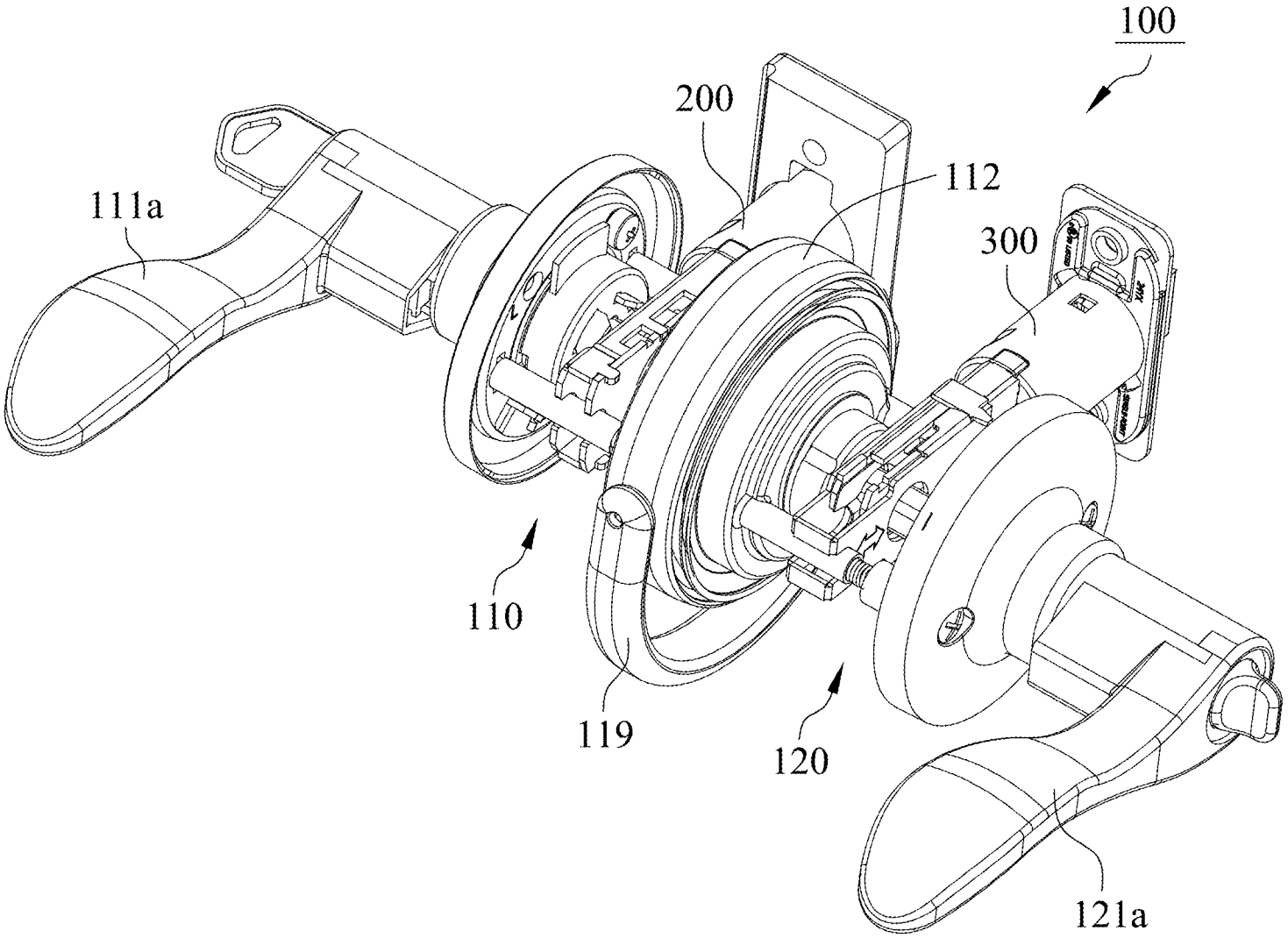
FIG. 2 is a perspective assembly diagram illustrating the lock assembly engaged to a latch in accordance with an embodiment of the present invention.

With reference to FIGS. 1 and 2, a double-door lock assembly 100 of the present invention includes a first lock 110 and a second lock 120, Similar to the related invention, published in Taiwan Pat. No. TW I611089 B, U.S Pub. No. US 2018/0328077 A1, and China Pub. No. CN 108868376 A and entitled "double-door lock assembly", the first lock 110 and the second lock 120 are mounted on a first door D1 and a second door D2, respectively. The first door D1 and the second door D2 can be open and closed simultaneously or individually. In this embodiment, the first lock 110 mounted on the first door D1 is provided to actuate a first latch 200 and the second lock 120 mounted on the second door D2 is provided to actuate a second latch 300.

Figure 3:
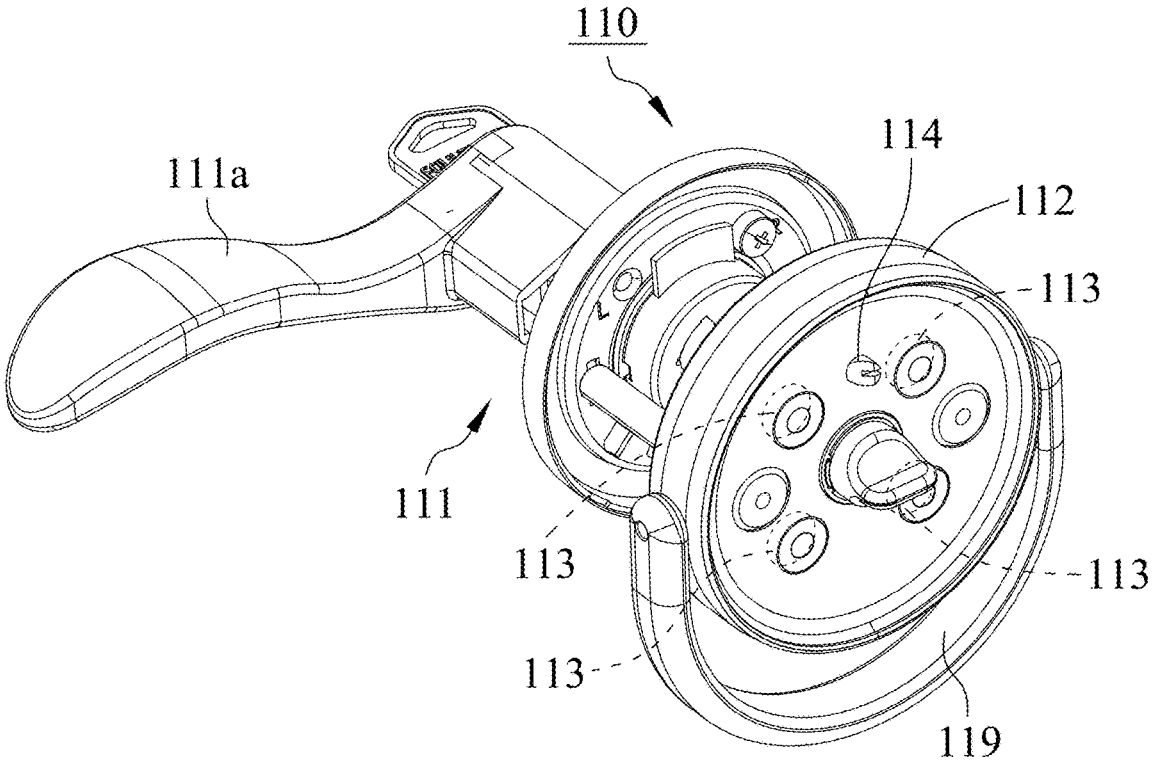
FIG. 3 is a perspective assembly diagram illustrating a first lock in accordance with an embodiment of the present invention.
Figure 5:
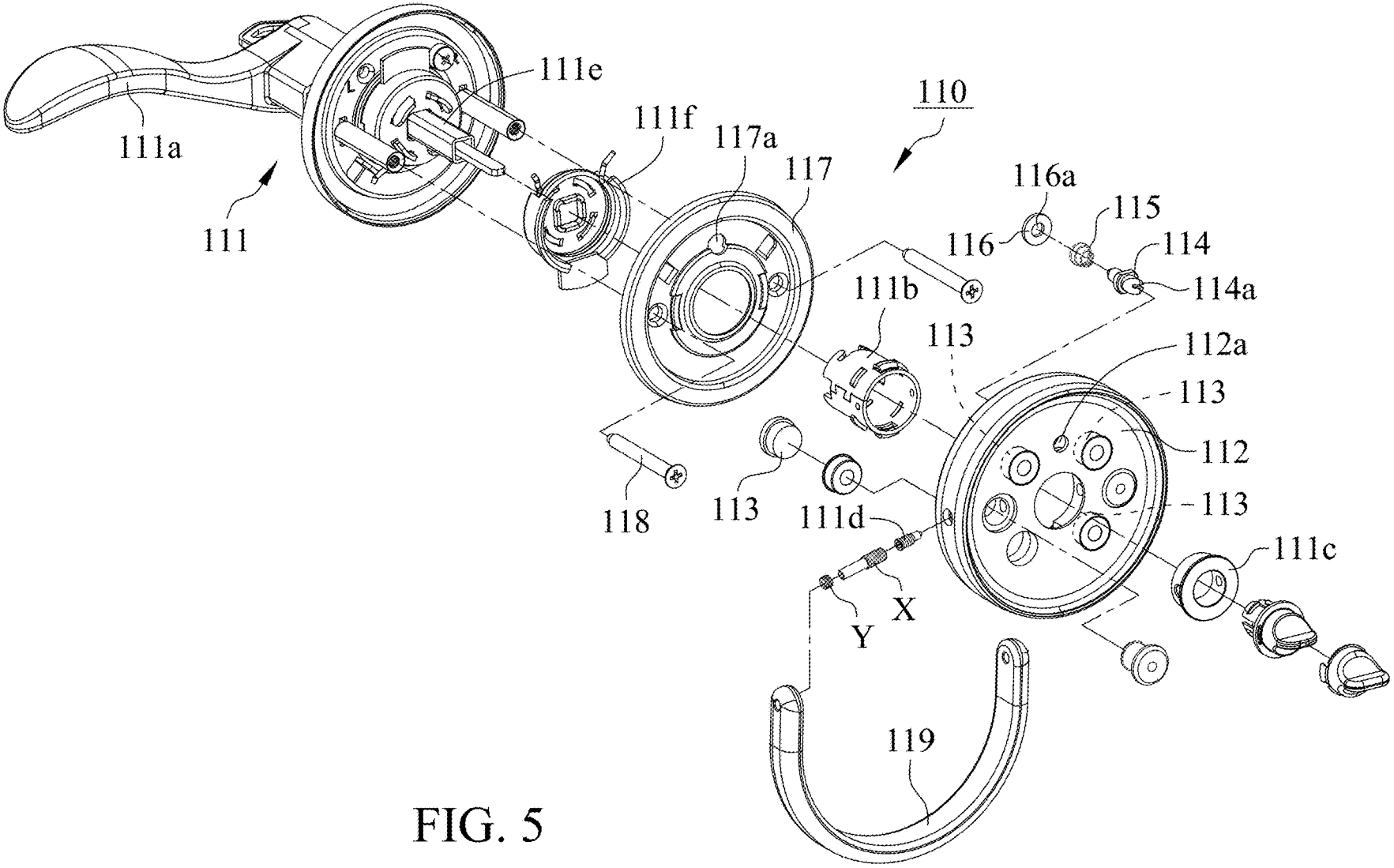
FIG. 5 is a perspective exploded diagram illustrating the first lock in accordance with an embodiment of the present invention.

With reference to FIGS. 3 and 5, the first lock 110 includes a first handle set 111, a first rotary member 112, at least one first magnetic member 113 and a linkage member 114. The first handle set 111 can rotate the first rotary member 112. The first magnetic member 113 and the linkage member 114 are placed on the first rotary member 112 such that they are moved with the first rotary member 112. In this embodiment, the first handle set 111 includes a first handle 111*a* and a shaft tube 111*b*, the first handle 111*a* is used to drive the shaft tube 111*b* to rotate the first rotary member 112.

With reference to FIG. 5, the first handle set 111 further preferably includes a connection member 111*c* and a fixing member 111*d*. The connection member 111*c* is connected to the shaft tube 111*b*, and the fixing member 111*d* is used to integrate the connection member 111*c* and the shaft tube 111*b* to the first rotary member 112 such that the first rotary member 112 can be rotated by the first handle 111*a* via the shaft tube 111*b* and the connection member 111*c*.

With reference to FIGS. 2 and 5, the first handle set 111 further includes a first transmission tube 111*e* and a transmission plate 111*f*. The first transmission tube 111*e* is engaged to the first handle 111*a* and inserted into the transmission plate 111*f* and the first latch 200, and the shaft tube 111*b* is engaged to the transmission plate 111*f*. Turning the first handle 111*a* will rotate the first rotary member 112 through the first transmission tube 111*e*, the transmission plate 111*f*, the shaft tube 111*b* and the connection member 111*c* to operate a latchbolt (not shown) of the first latch 200.

With reference to FIGS. 3 and 5, the linkage member 114 is movably disposed in an accommodation hole 112*a* of the first rotary member 112 and may be moved into or protruded from the accommodation hole 112*a*. In this embodiment, the first lock 110 further includes an elastic member 115 which is also disposed in the accommodation hole 112*a* of the first rotary member 112. The elastic member 115 is provided to push the linkage member 114 to allow a first end 114*a* of the linkage member 114 to protrude from the accommodation hole 112*a*.

Figure 11:
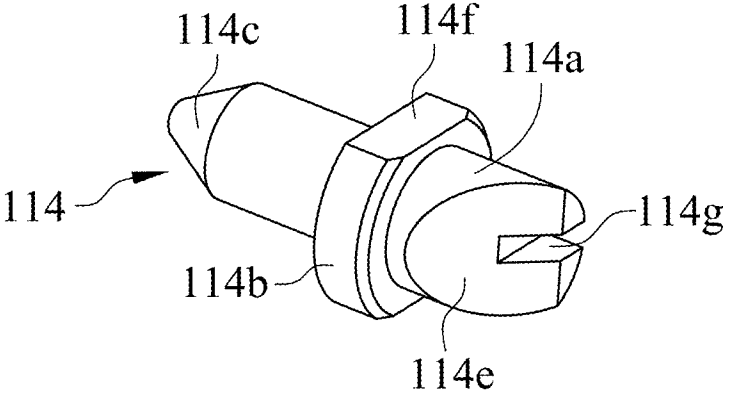
FIG. 11 is a perspective diagram illustrating a linkage member in accordance with an embodiment of the present invention.
Figure 12:
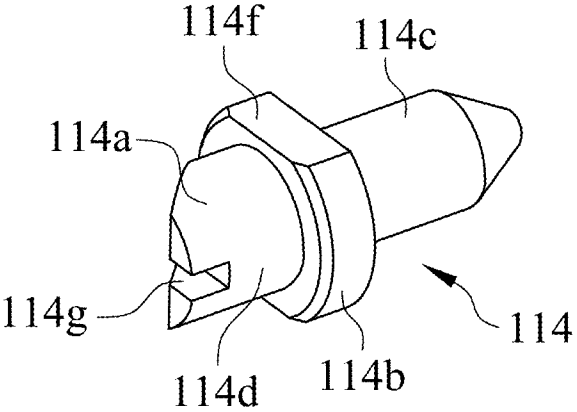
FIG. 12 is a perspective diagram illustrating the linkage member in accordance with an embodiment of the present invention.

With reference to FIGS. 11 and 12, in this embodiment, the first end 114*a* of the linkage member 114 has a blocking surface 114*d* and an inclined guide surface 114*e* which are located on different sides of the first end 114*a*.

With reference to FIGS. 5 and 11, the linkage member 114 of this embodiment further has a limited portion 114*b* and a second end 114*c*. The hunted portion 114*b* is located between the first end 114*a* and the second end 114*c*, and the elastic member 115 is provided to push the limited portion 114*b* to flake the first end 114*a* protrude from the accommodation hole 112*a*. The first handle set 111 further preferably includes a blocking member 116 disposed on the first rotary member 112, and particularly, the blocking member 116 is disposed in the accommodation hole 112*a*. The elastic member 115 is retained between the restriction member 114*b* and the blocking member 116 so that the elastic member 115 compressed by the linkage member 114 can exert a return force to push the linkage member 114.

Figure 13:
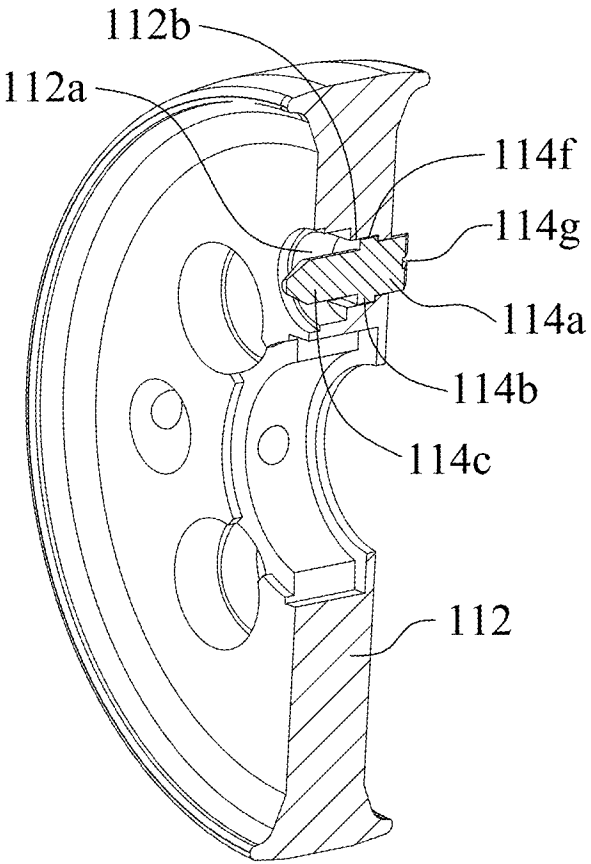
FIG. 13 is a perspective cross-section view diagram illustrating the linkage member mounted on the first rotary member in accordance with an embodiment of the present invention.

With reference to FIGS. 11, 12 and 13, a first limitation surface 112*b* in the accommodation hole 112*a* of the first rotary member 112 is designed to limit the limited portion 114*b* of the linkage member 114. In this embodiment, the first limitation surface 112*b* is designed to stop the rotation of the linkage member 114 in the accommodation hole 112*a* by limiting a second limitation surface 114*f* of the limited portion 114*b*.

With reference to FIGS. 3 and 5, the first lock 110 includes a mounting plate 117 which is engaged with the first handle set 111 by using at least one fixing rod 118, such that the mounting plate 117 will not be rotated by the first handle set 111. In this embodiment, the mounting plate 117 has a relief hole 117*a* aligned with the linkage member 114 and the blocking member 116 has a through hole 116*a* aligned with the linkage member 114 and the relief hole 117*a*. Besides, the first lock 110 further includes a driving handle 119 connected to the first rotary member 112 by using an adjusting screw X and a spring Y The driving handle 119 is used to drive the first rotary member 112 while the first door D1 and the second door D2 are open individually.

Figure 4:
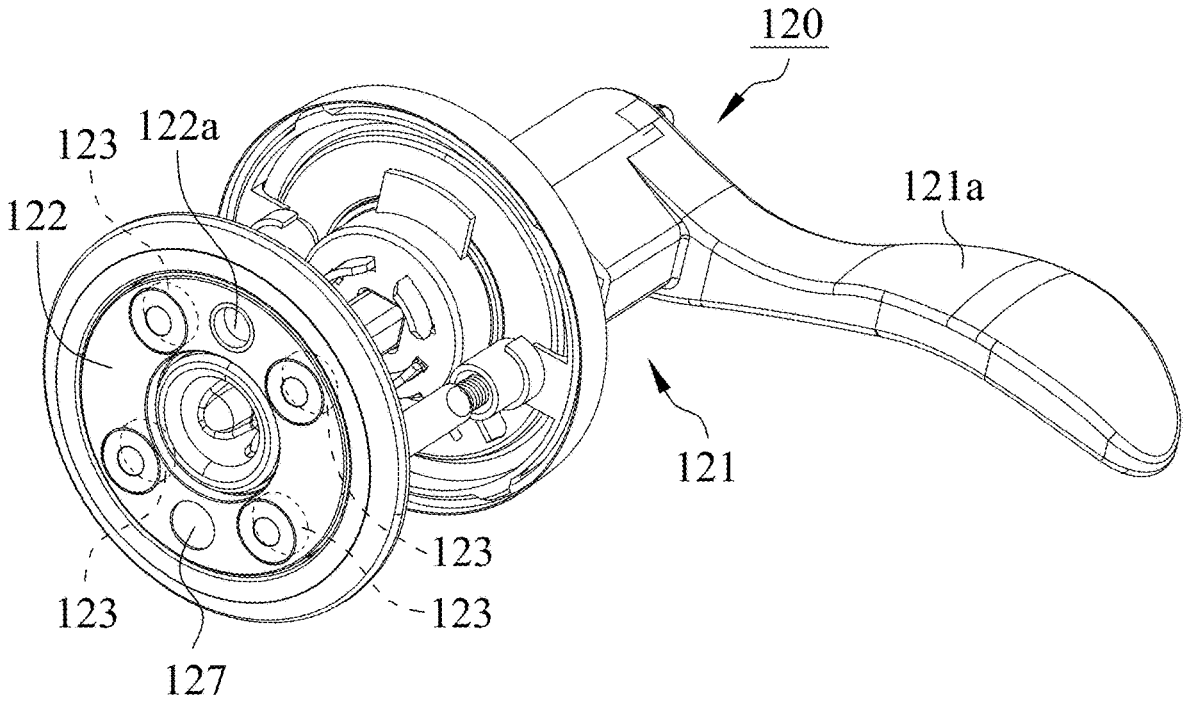
FIG. 4 is a perspective assembly diagram illustrating a second lock in accordance with an embodiment of the present invention.
Figure 6:
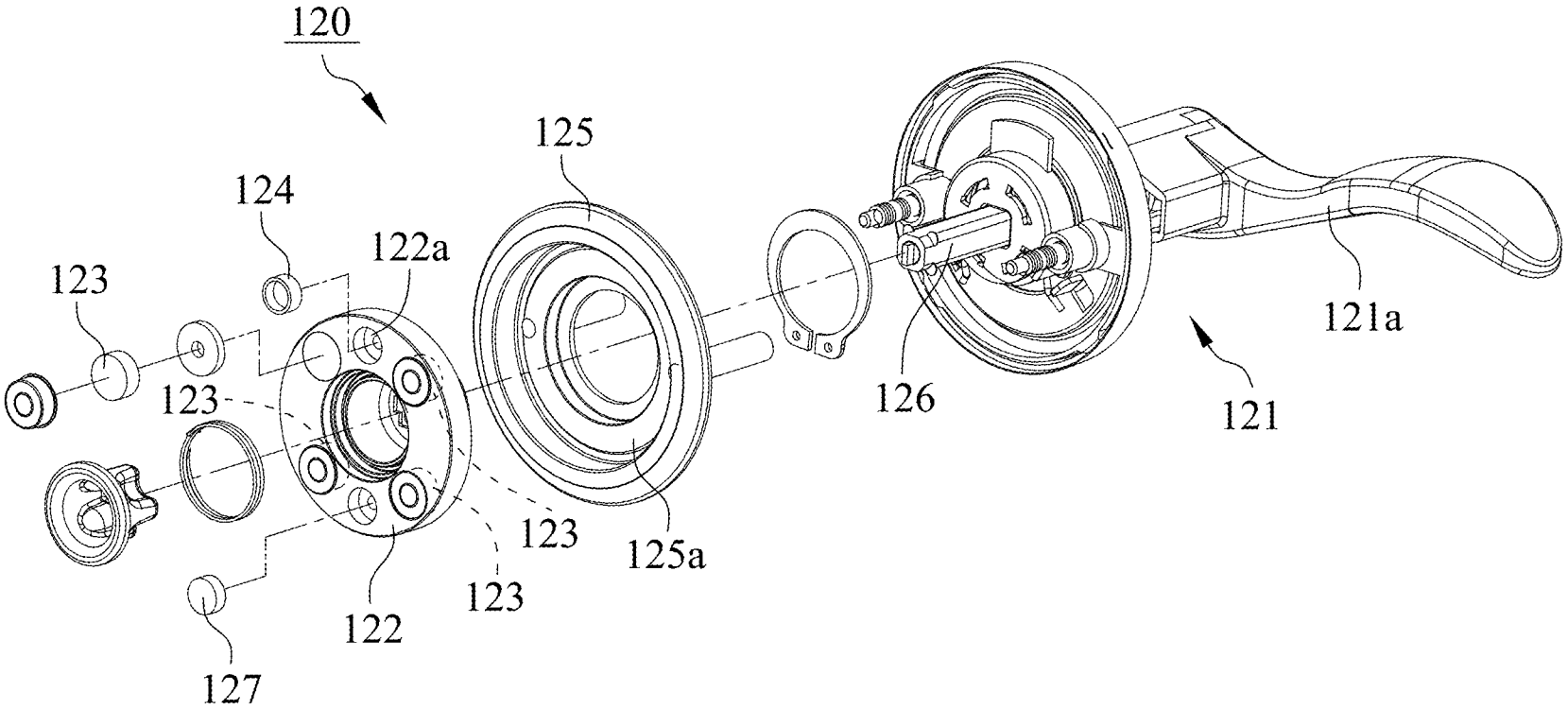
FIG. 6 is a perspective exploded diagram illustrating the second lock in accordance with an embodiment of the present invention.

With reference to FIGS. 4 and 6, the second lock 120 includes a second handle set 121, a second rotary member 122, at least one second magnetic member 123 and a driving portion 122*a*. The second handle set 121 is used to drive the second rotary member 122 in rotation, the second magnetic member 123 and the driving portion 122*a* are disposed on the second rotary member 122 and moved with the second rotary member 122. The driving portion 122*a* may be a recess or rib, and in this embodiment, the driving portion 122*a* is a recess. The second lock 120 further preferably includes a collar 124 disposed in the recess.

With reference to FIGS. 4 and 6, the second handle set 121 includes a second handle 121*a* and the second lock 120 further includes a base 125 and a second transmission tube 126 in this embodiment. The base 125 is fixed on the second handle set 121 and will not be rotated by the second handle set 121.

The second rotary member 122 is rotatably received in a receiving groove 125*a* of the base 125. Both ends of the second transmission tube 126 are engaged to the second handle 121*a* and the second rotary member 122, respectively, and the second latch 300 is set on the second transmission tube 126. User can turn the second handle 121*a* to rotate the second rotary member 122 via the second transmission tube 126 and actuate a latchbolt (not shown) of the second latch 300.

Figure 7:
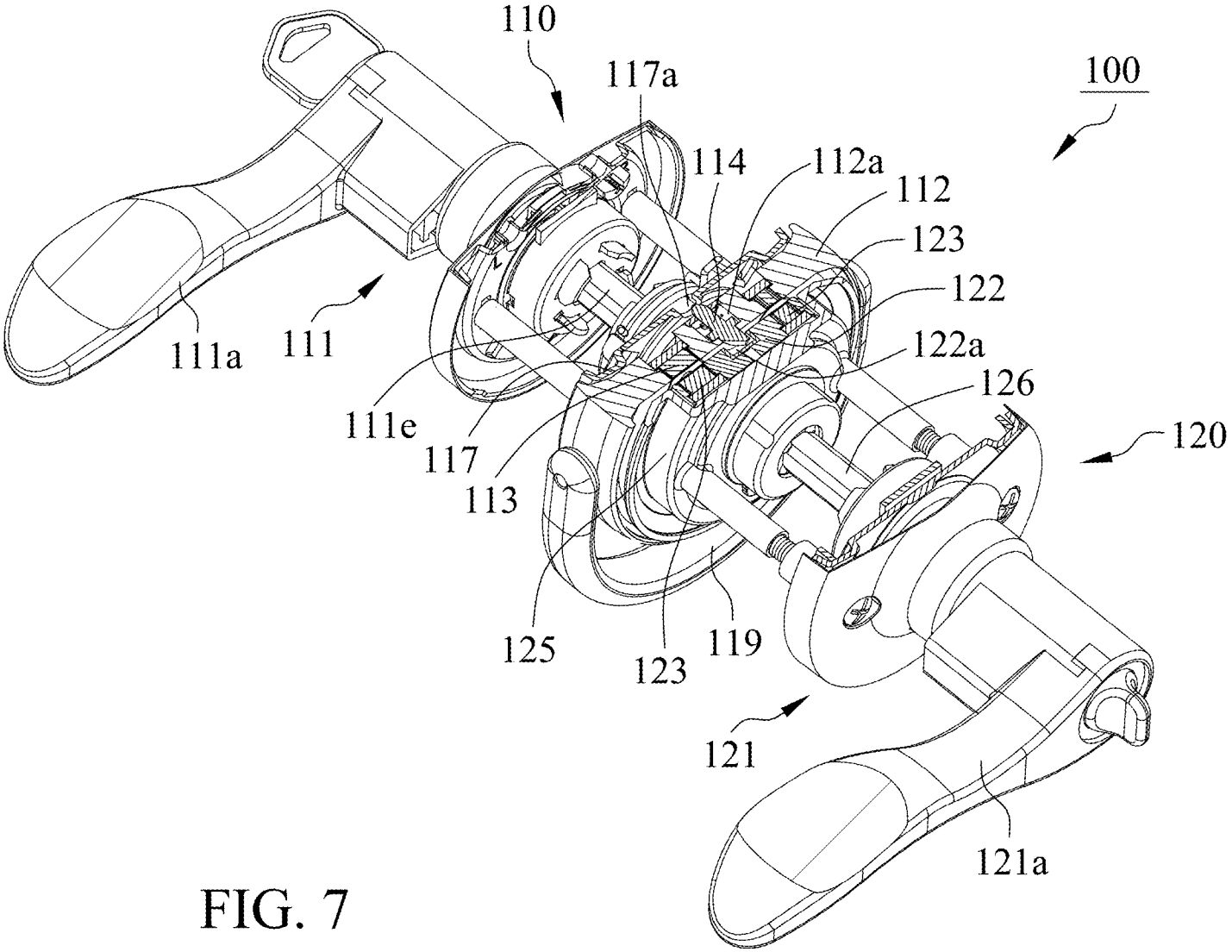
FIG. 7 is a perspective cross-section view diagram illustrating the lock assembly before actuation in accordance with an embodiment of the present invention.
Figure 8:
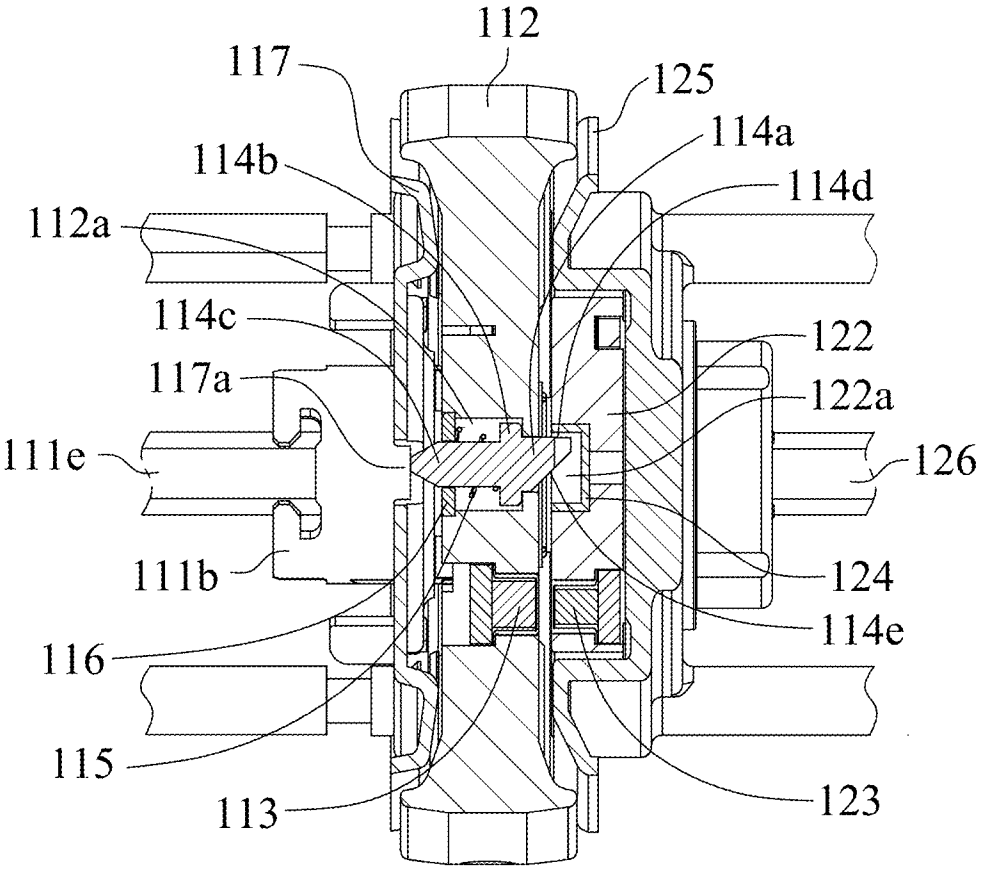
FIG. 8 is a partial cross-section view diagram illustrating the lock assembly in accordance with an embodiment of the present invention.

With reference to FIGS. 7 and 8, the first lock 110 and the second lock 120 are attracted to each other by using the first magnetic member 113 and the second magnetic member 123.

Figure 9:
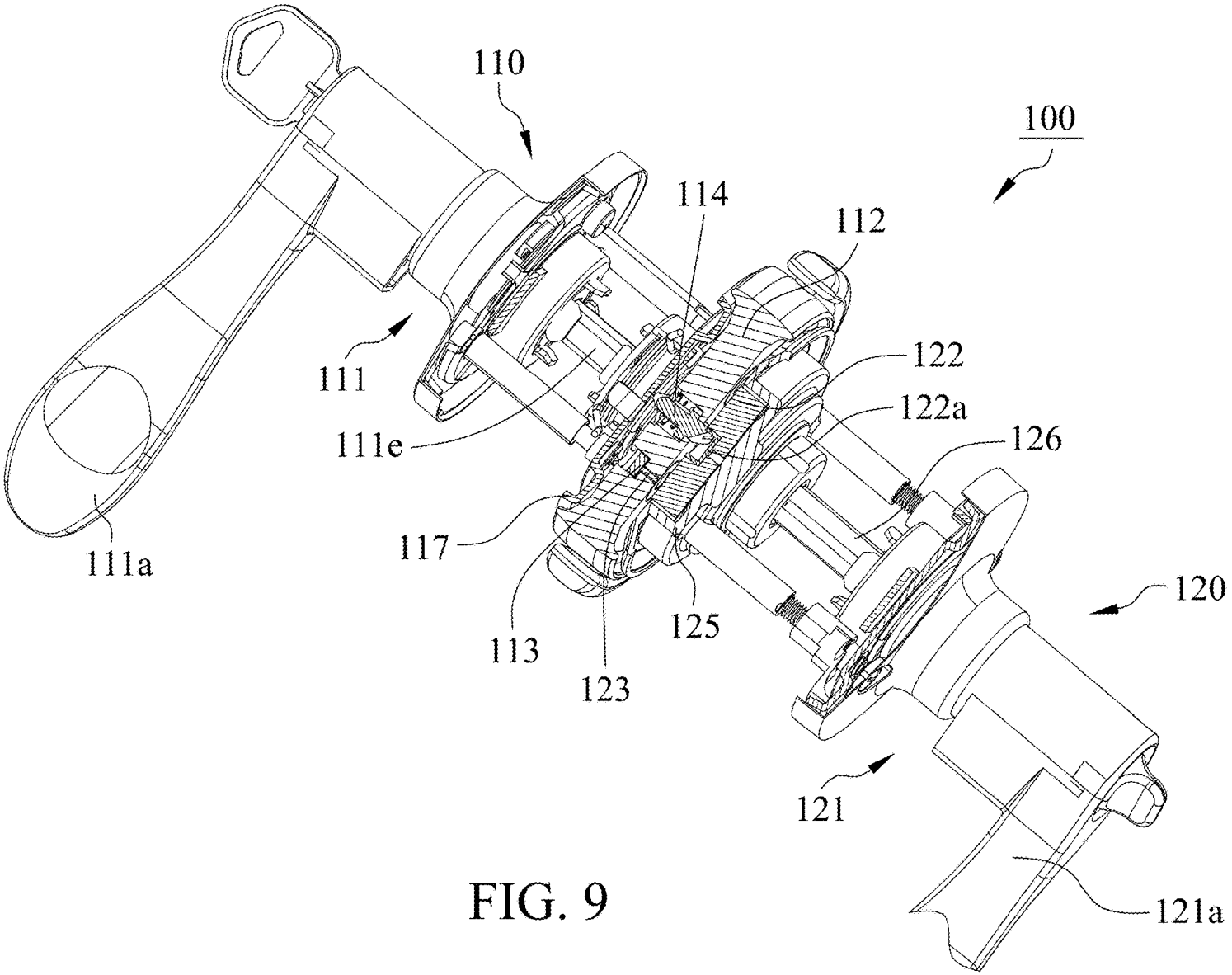
FIG. 9 is a perspective cross-section view diagram illustrating the lock assembly when turning a second handle downwardly in accordance with an embodiment of the present invention.

With reference to FIGS. 7, 8 and 9, while the first end 114*a* of the linkage member 114 is protruded from the accommodation hole 112*a* and the first magnetic member 113 is attracted to the second magnetic member 123, turning the second handle 121*a* downwardly can drive the second transmission tube 126 to rotate the second rotary member 122 and actuate the latchbolt (not shown) of the second latch 300 and can move the driving portion 122*a* to contact against the blocking surface 114*d* of the linkage member 114 protruded from the accommodation hole 112*a*. Accordingly, the linkage member 114 can drive the first rotary member 112 to rotate with the second rotary member 122 and also drive the shaft tube 111*b*, the transmission plate 111*f* and the first transmission tube 111*e* to rotate with the first rotary member 111*b*. By the attraction of the first magnetic member 113 and the second magnetic member 123 and the linkage member 114 pushed by the driving portion 122*a*, the second rotary member 122 and the first rotary member 112 can be rotated together. The first rotary member 112 can drive the first transmission tube 111*e* to actuate the latchbolt (not shown) of the first latch 200 to open or close the first door D1 and the second door D2 simultaneously.

With reference to FIGS. 7, 8 and 9, the linkage member 114 on the first rotary member 112 of the first lock 110 and the driving portion 122*a* on the second rotary member 122 of the second lock 120 are utilized to improve cooperation reliability of the first lock 110 and the second lock 120 when actuating the lock assembly 100.

With reference to FIGS. 7 and 8, similarly, rotating the first handle 111*a* downwardly can drive the rotation of the first rotary member 112. When the first rotary member 112 is rotated and the driving portion 122*a* is moved to contact against the blocking surface 114*d* of the linkage member 114, the linkage member 114, which is rotated with the first rotary member 112 and unable to move into the accommodation hole 112*a* due to a second end 114*c* of the linkage member 114 contacts against the mounting plate 117, can drive the second rotary member 122 and the second transmission tube 126 to rotate. The synchronize rotation of the first rotary member 112 and the second rotary member 122 result from the first end 114*a* of the linkage member 114 contacting with the driving portion 122*a* realizes the synchronize operation of the first door D1 and the second door D2.

Figure 10:
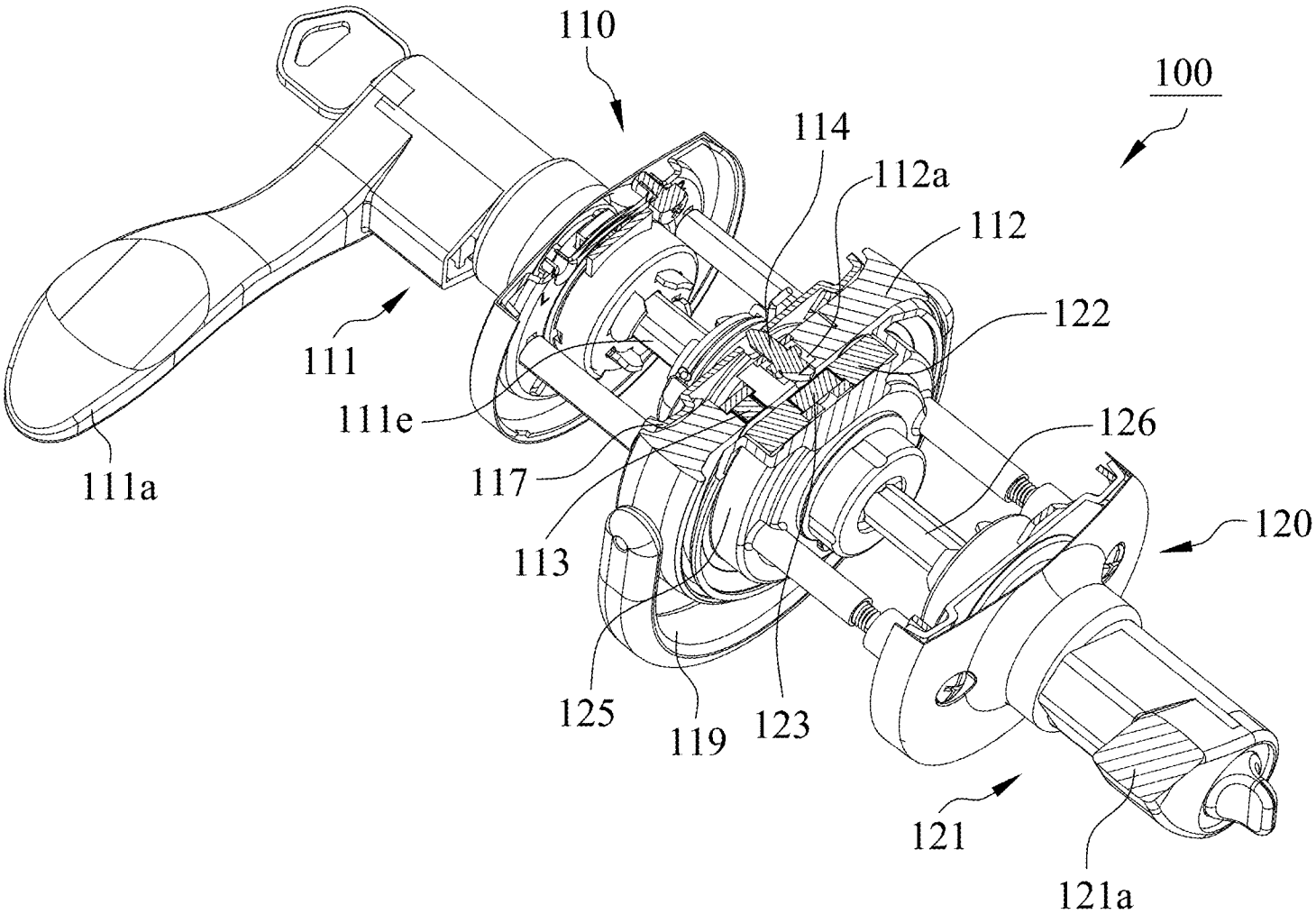
FIG. 10 is a perspective cross-section view diagram illustrating the lock assembly when turning the second handle upwardly in accordance with an embodiment of the present invention.

With reference to FIGS. 7, 8 and 10, turning the second handle 121*a* upwardly also can rotate the second rotary member 122 via the second transmission tube 126. However, when the second rotary member 122 is rotated to lead the driving portion 122*a* to press the inclined guide surface 114*e* of the linkage member 114, the second magnetic member 123 is moved with the second rotary member 122 to misalign the first magnetic member 113 and the linkage member 114 is pushed into the accommodation hole 112*a* of the first rotary member 112 by the driving portion 122*a* of the second rotary member 122. In this embodiment, the driving portion 122*a* can press the inclined guide surface 114*a* of the linkage member 114 to force the first end 114*a* of the linkage member 114 into the accommodation hole 112*a* of the first rotary member 112 and force the second end 114*c* of the linkage member 114 into the relief hole 117*a* of the mounting plate 117 so that the second rotary member 122 can be detached from the first rotary member 112 to separate the second lock 120 from the first lock 110 to open or close the first door D1 and the second door D2 individually.

With reference to FIGS. 3, 4, 5 and 6, the second lock 120 further includes at least one third magnetic member 127 disposed on the second rotary member 122. When the first magnetic member 113 and the second magnetic member 123 are misaligned due to the first rotary member 112 or the second rotary member 122 is rotated, the third magnetic member 127 corresponds and repels with the first magnetic member 113 and the linkage member 114 is pushed into the accommodation hole 112*a* of the first rotary member 112 by the driving portion 122*a* so as to separate the second rotary member 122 from the first rotary member 112.

With reference to FIGS. 7 and 8, different to the second handle 121*a*, pulling the first handle 111*a* upwardly can't separate the first rotary member 112 from the second rotary member 122. The first rotary member 112 and the linkage member 114 are rotated by the pulled-up first handle 111*a*, but the linkage member 114 is unable to be moved into the accommodation hole 112*a* because the second end 114*c* of the linkage member 114 contacts against the mounting plate 117 and the first rotary member 112 is unable to be rotated by the first handle set 111 owing to the blocking surface 114*d* contacts against the driving portion 122*a*. As a result, pulling up the first handle 111*a* can't separate the first lock 110 from the second lock 120.

Figure 15:
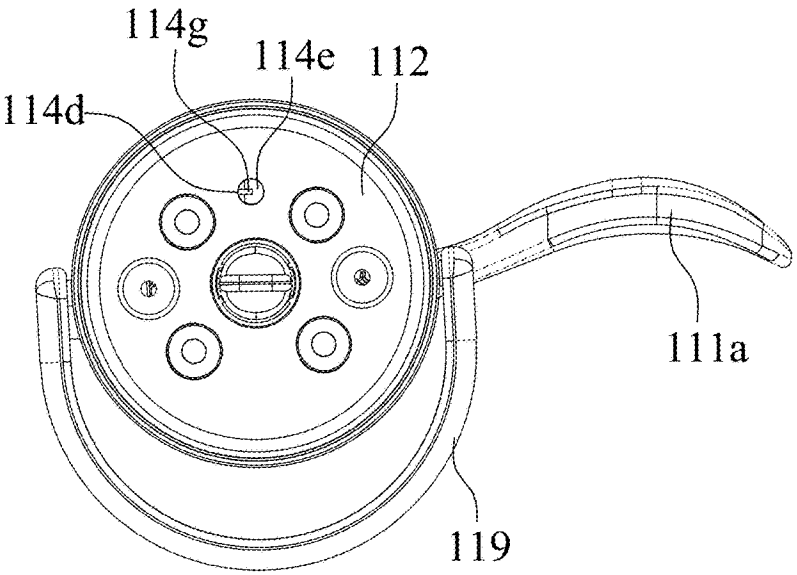
FIG. 15 is a lateral view diagram illustrating the linkage member mounted on the first lock in accordance with an embodiment of the present invention.
Figure 14:
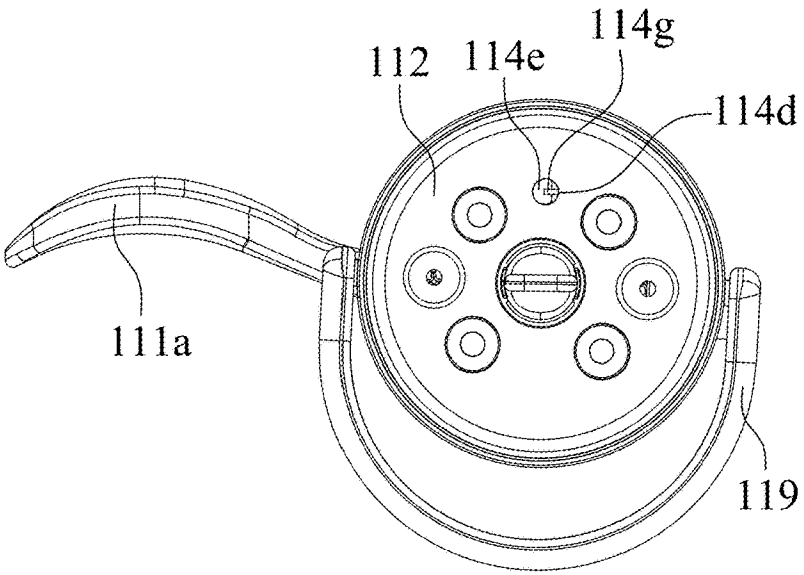
FIG. 14 is a lateral view diagram illustrating the linkage member mounted on the first lock in accordance with an embodiment of the present invention.

With reference to FIGS. 11, 12, 13 and 14, the lock assembly 100 is able to be mounted on left and right hand door by a recessed groove 114*g* on the first end 114*a* of the linkage member 114. Referring to FIGS. 3, 14 and 15, when a tool (not shown) is inserted into the recessed groove 114*g* to press the linkage member 114 inwardly, the second limitation surface 114*f* of the limited portion 114*b* is moved away from the first limitation surface 112*h* of the accommodation hole 112*a* such that the linkage member 114 is rotatable to allow the lock assembly 100 to be mounted on left or right hand door.

While this invention has been particularly illustrated and described in detail with respect to the preferred embodiments thereof it will be clearly understood by those skilled in the art that is not limited to the specific features shown and described and various modified and changed in form and details may be made without departing from the spirit and scope of this invention.

What is claimed is:

1. A lock assembly for operating a first door and a second door simultaneously or individually, the lock assembly comprising:

a first lock designed to be mounted to the first door and including a first handle set, a first rotary member rotated by the first handle set, at least one first magnetic member and a linkage member, the at least one first magnetic member and the linkage member are disposed on and moved with the first rotary member, the linkage member is movably disposed in an accommodation hole of the first rotary member and able to be moved into or protruded from the accommodation hole, a first end of the linkage member has a blocking surface; and a second lock designed to be mounted to the second door and including a second handle set, a second rotary member rotated by the second handle set, at least one second magnetic member and a driving portion, the at least one second magnetic member and the driving portion are disposed on and moved with the second rotary member, wherein when the at least one first magnetic member and the at least one second magnetic member are attracted to each other and the linkage member is protruded from the accommodation hole, the driving portion contacts against the blocking surface of the linkage member such that the first and second rotary members are able to be rotated simultaneously.

2. The lock assembly in accordance with claim 1, wherein the first end of the linkage member has an inclined guide surface, and the inclined guide surface and the blocking surface are located on different sides of the first end.

3. The lock assembly in accordance with claim 2, wherein when the first rotary member or the second rotary member is rotated to misalign the at least one first magnetic member and the at least one second magnetic member, the driving portion contacts against the linkage member to move the linkage member into the accommodation hole of the first rotary member such that the first rotary member and the second rotary member are able to be separated from each other.

4. The lock assembly in accordance with claim 3, wherein at least one third magnetic member is disposed on the second rotary member and repelled by the at least one first magnetic member.

5. The lock assembly in accordance with claim 1, wherein the first lock further includes a mounting plate which is engaged to the first handle set and unable to be rotated by the first handle set, a second end of the linkage member contacts against the mounting plate to stop the movement of the linkage member into the accommodation hole when the first rotary member is rotated and the driving portion contacts against the blocking surface of the linkage member.

6. The lock assembly in accordance with claim 3, wherein the first lock further includes a mounting plate which is engaged to the first handle set and unable to be rotated by the first handle set, a second end of the linkage member is moved in a relief hole of the mounting plate when the second rotary member is rotated and the driving portion contacts against the inclined guide surface of the linkage member.

7. The lock assembly in accordance with claim 1, wherein the first lock further includes an elastic member disposed in the accommodation hole of the first rotary member, the elastic member is used to push the linkage member such that the first end of the linkage member is protruded from the accommodation hole.

8. The lock assembly in accordance with claim 7, wherein the linkage member includes a limited portion and a second end, the limited portion is located between the first and second ends and pushed by the elastic member.

9. The lock assembly in accordance with claim 8, wherein the first lock further includes a blocking member disposed on the first rotary member, the elastic member is retained between the limited portion and the blocking member.

10. The lock assembly in accordance with claim 8, wherein there is a first limitation surface in the accommodation hole for limiting a second limitation surface on the limited portion of the linkage member.

11. The lock assembly in accordance with claim 1, wherein a recessed groove is formed on the first end of the linkage member.

12. The lock assembly in accordance with claim 1, wherein the first handle set includes a shaft tube, a connection member connected to the shaft tube and a fixing member, and the connection member and the shaft tube are integrated to the first rotary member by the fixing member.

13. The lock assembly in accordance with claim 1, wherein the driving portion is a recess or a rib.

14. A lock assembly for operating a first door and a second door simultaneously or individually, the lock assembly comprising:

a first lock designed to be mounted to the first door and including a first handle set, a first rotary member rotated by the first handle set and a linkage member disposed on and moved with the first rotary member, the linkage member is moveably disposed in an accommodation hole of the first rotary member and able to be moved into or protruded from the accommodation hole, a first end of the linkage member has a blocking surface and an inclined guide surface located on different sides of the first end; and a second lock designed to be mounted to the second door and including a second handle set, a second rotary member rotated by the second handle set and a driving portion disposed on and moved with the second rotary member, wherein the first and second rotary members are able to be rotated simultaneously when the driving portion contacts against the blocking surface of the linkage member protruded from the accommodation hole, and wherein the first and second rotary members are able to be separated from each other when the driving portion contacts against the inclined guide surface of the linkage member protruded from the accommodation hole to push the linkage member into the accommodation hole.

15. The lock assembly in accordance with claim 14, wherein the first lock further includes a mounting plate which is engaged to the first handle set and unable to be rotated by the first handle set, a second end of the linkage member contacts against the mounting plate to stop the movement of the linkage member into the accommodation hole when the first rotary member is rotated and the driving portion contacts against the blocking surface of the linkage member.

16. The lock assembly in accordance with claim 14, wherein the first lock further includes a mounting plate which is engaged to the first handle set and unable to be rotated by the first handle set, a second end of the linkage member is moved in a relief hole of the mounting plate when the second rotary member is rotated and the driving portion contacts against the inclined guide surface of the linkage member.

17. The lock assembly in accordance with claim 14, wherein the first lock further includes an elastic member disposed in the accommodation hole of the first rotary member, the elastic member is used to push the linkage member such that the first end of the linkage member is protruded from the accommodation hole.

18. The lock assembly in accordance with claim 17, wherein the linkage member includes a limited portion and a second end, the limited portion is located between the first and second ends and pushed by the elastic member.

19. The lock assembly in accordance with claim 18, wherein the first lock further includes a blocking member disposed on the first rotary member, the elastic member is retained between the limited portion and the blocking member.

20. The lock assembly in accordance with claim 18, wherein there is a first limitation surface in the accommodation hole for limiting a second limitation surface on the limited portion of the linkage member.

21. The lock assembly in accordance with claim 14, wherein a recessed groove is formed on the first end of the linkage member.

22. The lock assembly in accordance with claim 14, wherein the first handle set includes a shaft tube, a connection member connected to the shaft tube and a fixing member, and the connection member and the shaft tube are integrated to the first rotary member by the fixing member.

23. The lock assembly in accordance with claim 14, wherein the driving portion is a recess or a rib.

* * * * *